US006457773B1

(12) United States Patent
Gates

(10) Patent No.: US 6,457,773 B1
(45) Date of Patent: Oct. 1, 2002

(54) TRANSPORTABLE CUSHIONING DEVICE

(76) Inventor: Richard L. Gates, 405 E. Providence, Casa Grande, AZ (US) 85222

( * ) Notice: Subject to any disclaimer, the term of this patent is extended or adjusted under 35 U.S.C. 154(b) by 0 days.

(21) Appl. No.: 09/944,010

(22) Filed: Aug. 31, 2001

(51) Int. Cl.[7] ..... A47C 31/00

(52) U.S. Cl. ..... 297/228.12; 297/219.1; 297/452.2; 297/452.21

(58) Field of Search ..... 297/452.21, 452.22, 297/452.23, 452.24, 452.27, 452.284, 452.47, 452.46, 452.17, 219.1, 228.12; 5/653, 655.4

(56) References Cited

U.S. PATENT DOCUMENTS

| | | | | | |
|---|---|---|---|---|---|
| 630,911 | A | * | 8/1899 | Moore | 297/202 |
| 3,205,010 | A | * | 9/1965 | Schick | 297/452.36 |
| 3,222,694 | A | * | 12/1965 | Schick | 5/653 |
| 3,382,511 | A | * | 5/1968 | Brooks | 5/652 |
| 4,132,228 | A | | 1/1979 | Green | |
| 4,718,727 | A | | 1/1988 | Sheppard | |
| 4,824,174 | A | * | 4/1989 | Dunn, Sr. | 297/453 |
| 4,883,320 | A | | 11/1989 | Izumida | |
| 5,134,740 | A | * | 8/1992 | Summer | 5/652 |
| 5,286,089 | A | * | 2/1994 | Goldman | 297/452.26 |
| D354,876 | S | | 1/1995 | Pace | |
| 5,522,106 | A | | 6/1996 | Harrison et al. | |
| 5,733,012 | A | * | 3/1998 | Jones | 297/452.17 |
| 5,868,463 | A | * | 2/1999 | MacKenzie et al. | 297/228.12 |
| 5,957,528 | A | * | 9/1999 | Campbell | 297/228.12 |

* cited by examiner

*Primary Examiner*—Peter M. Cuomo
*Assistant Examiner*—Stephanie Harris

(57) ABSTRACT

A transportable cushioning device for supporting a buttocks portion of a user while sitting in a seat. The transportable cushioning device includes an inner cushioning assembly for supporting the buttocks portion of the user sitting in the seat. The inner cushioning assembly includes a support layer for supporting the buttocks portion of the user and a comfort layer for contouring to the buttocks portion of the user in order to provide comfort to the user. A covering is provided for covering all of the layers.

16 Claims, 3 Drawing Sheets

TRANSPORTABLE CUSHIONING DEVICE

BACKGROUND OF THE INVENTION

1. Field of the Invention

The present invention relates to seat cushions and more particularly pertains to a new transportable cushioning device for supporting a buttocks portion of a user while sitting in a seat.

2. Description of the Prior Art

The use of seat cushions is known in the prior art. More specifically, seat cushions heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,132,228; 5,522,106; 5,733,012; 3,382,511; 4,883,320; U.S. Pat. No. Des. 354,876; and U.S. Pat. No. 4,718,727.

While these devices fulfill their respective, particular objectives and requirements, the aforementioned patents do not disclose a new transportable cushioning device. The inventive device includes an inner cushioning assembly for supporting the buttocks portion of the user sitting in the seat. The inner cushioning assembly includes a support layer for supporting the buttocks portion of the user and a comfort layer for contouring to the buttocks portion of the user in order to provide comfort to the user. A covering is provided for covering all of the layers.

In these respects, the transportable cushioning device according to the present invention substantially departs from the conventional concepts and designs of the prior art, and in so doing provides an apparatus primarily developed for the purpose of supporting a buttocks portion of a user while sitting in a seat.

SUMMARY OF THE INVENTION

In view of the foregoing disadvantages inherent in the known types of seat cushions now present in the prior art, the present invention provides a new transportable cushioning device construction wherein the same can be utilized for supporting a buttocks, portion of a user while sitting in a seat.

The general purpose of the present invention, which will be described subsequently in greater detail, is to provide a new transportable cushioning device apparatus and method which has many of the advantages of the seat cushions mentioned heretofore and many novel features that result in a new transportable cushioning device which is not anticipated, rendered obvious, suggested, or even implied by any of the prior art seat cushions, either alone or in any combination thereof.

To attain this, the present invention generally comprises an inner cushioning assembly for supporting the buttocks portion of the user sitting in the seat. The inner cushioning assembly includes a support layer for supporting the buttocks portion of the user and a comfort layer for contouring to the buttocks portion of the user in order to provide comfort to the user. A covering is provided for covering all of the layers.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical,disclosure of the application. The abstract is neither intended to define the invention of the application, which is measured by the claims, nor is it intended to be limiting as to the scope of the invention in any way.

It is therefore an object of the present invention to provide a new transportable cushioning device apparatus and method which has many of the advantages of the seat cushions mentioned heretofore and many novel features that result in a new transportable cushioning device which is not anticipated, rendered obvious, suggested, or even implied by any of the prior art seat cushions, either alone or in any combination thereof.

It is another object of the present invention to provide a new transportable cushioning device which may be easily and efficiently manufactured and marketed.

It is a further object of the present invention to provide a new transportable cushioning device which is of a durable and reliable construction.

An even further object of the present invention is to provide a new transportable cushioning device which is susceptible of a low cost of manufacture with regard to both materials and labor, and which accordingly is then susceptible of low prices of sale to the consuming public, thereby making such transportable cushioning device economically available to the buying public.

Still yet another object of the present invention is to provide a new transportable cushioning device which provides in the apparatuses and methods of the prior art some of the advantages thereof, while simultaneously overcoming some of the disadvantages normally associated therewith.

Still another object of the present invention is to provide a new transportable cushioning device for supporting a buttocks portion of a user while sitting in a seat.

Yet another object of the present invention is to provide a new transportable cushioning device which includes an inner cushioning assembly for supporting the buttocks portion of the user sitting in the seat. The inner cushioning assembly includes a support layer for supporting the buttocks portion of the user and a comfort layer for contouring to the buttocks portion of the user in order to provide comfort to the user. A covering is provided for covering all of the layers.

Still yet another object of the present invention is to provide a new transportable cushioning device that is transportable and useable in a wide variety of chairs. The present invention is especially ideal for airplane seat, office chairs, dining chairs, motorcycles and wheel chairs.

Even still another object of the present invention is to provide a new transportable cushioning device that supports the tailbone of a user above the chair seat thereby removing pressure upon the tailbone. Relieving pressure from the tailbone eases stress on the tailbone and spine. allowing a user to sit for longer periods of time without discomfort associated with other seat cushions.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to, the following detailed description thereof. Such description makes reference to the annexed drawings wherein.

DESCRIPTION OF THE PREFERRED EMBODIMENT

Figure 1:
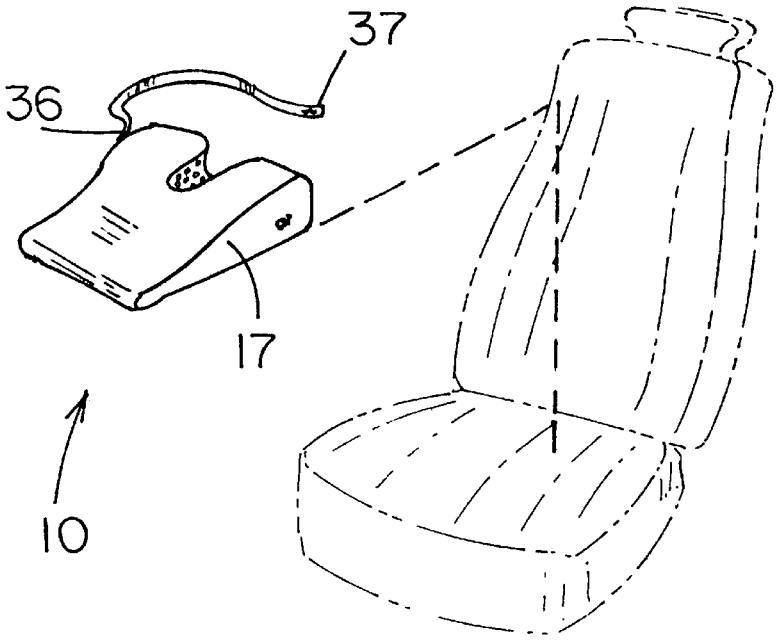
FIG. 1 is a schematic perspective view of a new transportable cushioning device according to the present invention.
Figure 6:
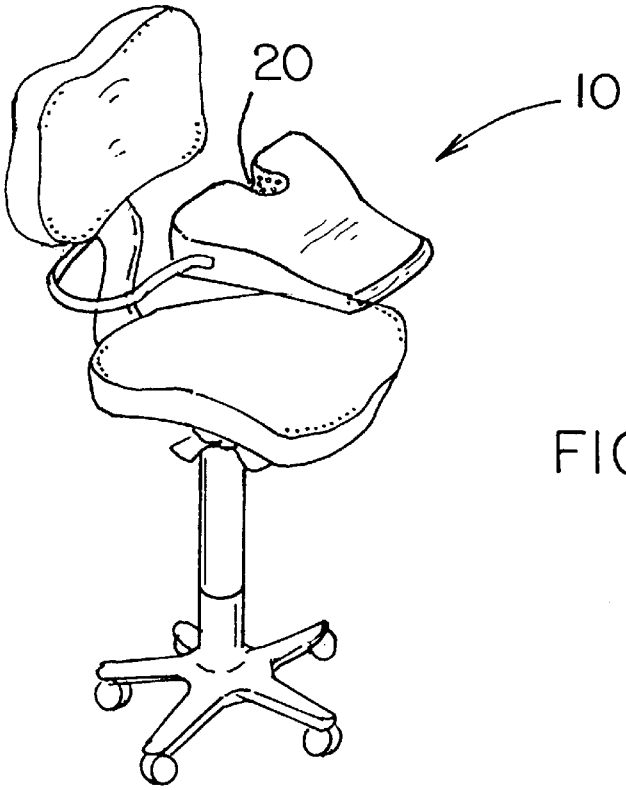
FIG. 6 is a schematic perspective view of the present invention being used on an office chair.
Figure 2:
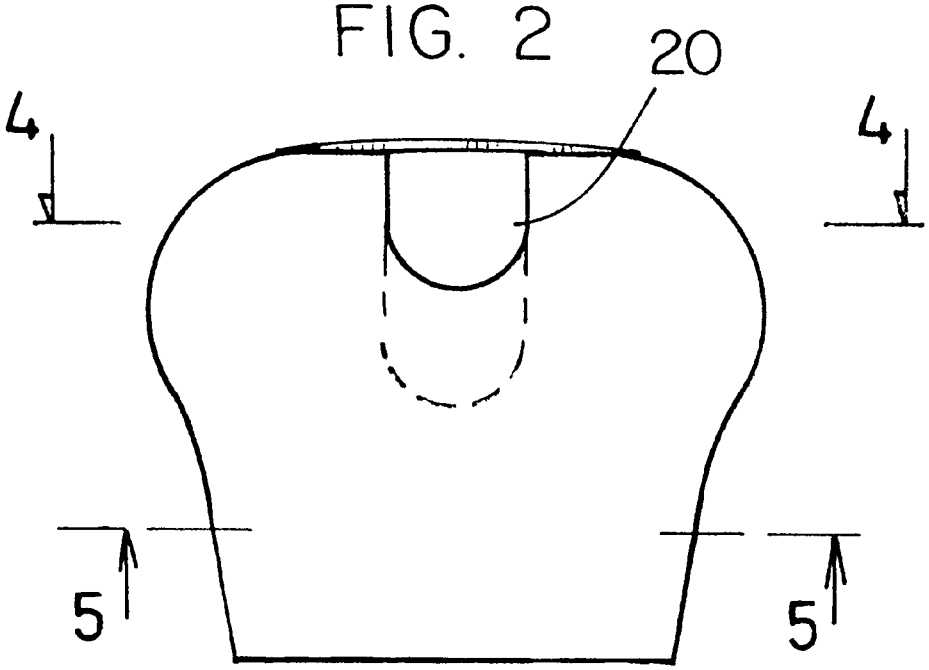
FIG. 2 is a schematic top view of the present invention.

With reference now to the drawings, and in particular to FIGS. 1 through 6 thereof, a new transportable cushioning device embodying the principles and concepts of the present invention and generally designated by the reference numeral 10 will be described.

As best illustrated in FIGS. 1 through 6, the transportable cushioning device 10 generally comprises an inner cushioning assembly 13 for supporting the buttocks portion of the user sitting in the seat. The inner cushioning assembly 13 includes a support layer 14 for supporting the buttocks portion of the user. The support layer 14 includes a first end 15, a second end 16, an upper surface 17, a lower surface 18 and a pair of side surfaces 19. The first end 15 of the support layer 14 may include a channel 20 extending therein for selectively receiving and supporting a tailbone portion of user. The channel 20 preferably extends between the upper 17 and lower 18 surfaces of the support layer 14.

Figure 3:
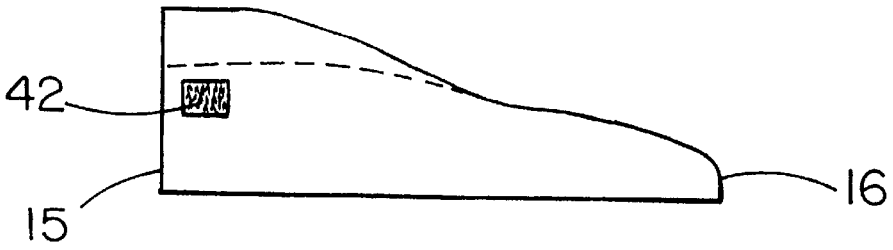
FIG. 3 is a schematic side view of the present invention.
Figure 4:
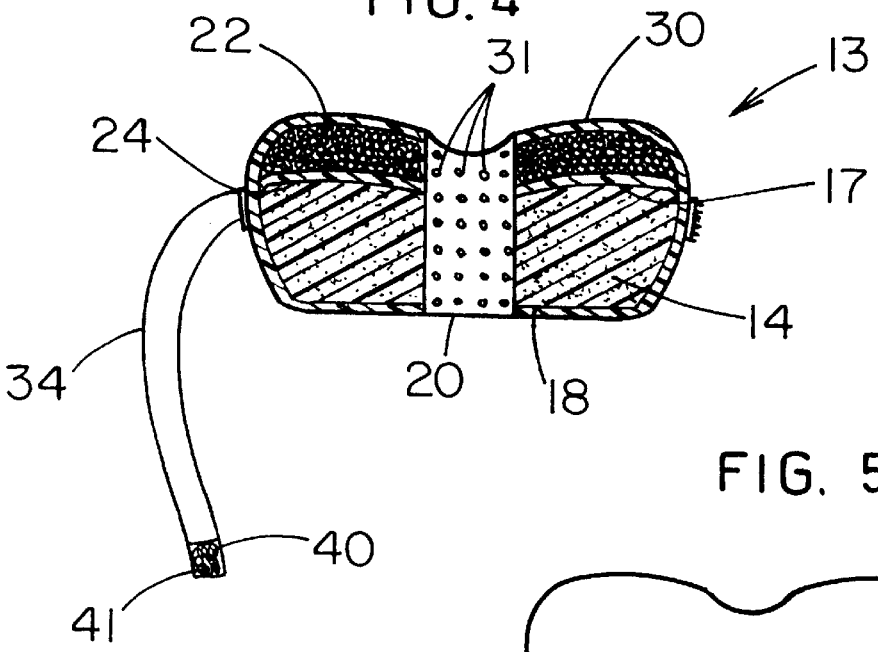
FIG. 4 is a schematic cross-sectional view of the present invention taken along line 4—4 of FIG. 2.
Figure 5:
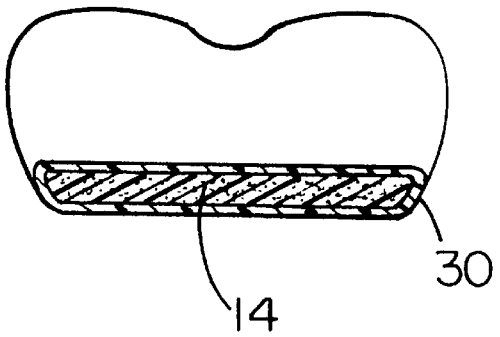
FIG. 5 is a schematic cross-sectional view of the present invention taken along line 5—5 of FIG. 2.

In one embodiment of the present invention, as particularly illustrated in FIG. 3, a thickness of the support layer 14 may taper from the first end 15 toward the second end 16 of the support layer 14. As particularly illustrated in FIG. 2, a width of the support layer 14 may also taper from the first end 15 toward the second end 16 of the support layer 14. The support layer 14 may have a thickness measuring approximately three-quarter inches. The support layer 14 may measure approximately eighteen inches in length between the first 15 and second 16 ends. The support layer may also measure approximately eighteen inches in width between the pair of side surfaces 19 of the support layer 14.

The first end 15 of the support layer 14 may include a generally planar surface for abutting against a back support portion of the seat. The support layer 14 may comprise a resiliently compressible material such as, for example, a foam-rubber material.

The inner cushioning assembly also includes a comfort layer 22 for contouring to the buttocks portion of the user in order to provide comfort to the user. The comfort layer 22 may be positioned generally on the upper surface 17 of support layer 14. In one embodiment of the present invention, a thickness of the comfort layer 22 tapers from the first end 15 of the support layer 14 toward a, central portion of the support layer 14. The comfort layer 22 may comprise a plurality of foam beads. The comfort layer 22 may have a thickness measuring approximately three-quarter inches, however the thickness of the comfort layer 22 may be varied.

An intermediate layer 24 may be provided for separating the comfort layer 22 from the support layer 14. The intermediate layer 24 may be mounted on the upper surface 17 of the support layer 14 and may be positioned generally between the comfort layer 22 and the support layer 14. The channel 20 in the support layer 14 preferably extends through the comfort layer 22 and through the intermediate layer 24. The intermediate layer 24 may comprise a material such as, for example, a cloth, vinyl or leather material.

A covering 30 is provided for covering all of the layers 14, 22 and 24. The covering 30 may extend about the support layer 14 and the comfort layer 22. A back portion of the covering 30 may be positioned in the channel 20. The back portion of the covering 30 may include a plurality of holes 31 extending therethrough for allowing air in each of the layers 14 and 22 to escape. Allowing the air to escape from the support 14 and comfort 22 layers allows the inner cushioning assembly 13 to more easily contour to the buttocks of the user. The covering 30 may comprise a material such as, for example, a cloth, vinyl, or leather material.

A securing member 34 may be provided for securing the inner cushion assembly 13 to the seat. The securing member 34 includes a first end 36 and a second end 37. The first end 36 of the securing member 34 may be mounted on the covering 30 and positioned generally adjacent to one of the pair of side surfaces 19 of the support layer 14. The second end 37 of the securing member may be extendable about the back support portion of the seat and releasably mounted on the covering 30. The second end 37 of the securing member 34 may be positioned generally adjacent to another of the side surfaces 19 of the support layer 14. In one embodiment of the present invention the securing member 34 may comprise an elongated strap. The securing member 34 may comprise a generally flexible material such as, for example, a cloth, vinyl or leather material.

A fastening member 40 may be provided for releasably fastening the second end 37 of the securing member 34 to the covering 30. The fastening member 40 may include a first portion 41 and a second portion 42. The first portion 41 may be mounted on the covering 30. The second portion 42 may be mounted on the securing member 34 and may be positioned generally adjacent to the second end 37 of the securing member 34. The fastening member 40 may comprise hook and loop fastener.

In use, the transportable cushioning device 10 is placed on a seat and removably secured to the seat back. As particularly illustrated in FIGS. 1, 6 and 6, the seat cushioning system 10 may be employed in a variety of locations wherein a user may have to sit for long periods of time. The channel 20 provides an area of the seat cushioning system 10 to better support the tailbone and spine of a user.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A transportable cushioning device for supporting a buttocks portion of a user while sitting in a seat, the seat including a seat support portion, said device comprising:

an inner cushioning assembly for supporting the buttocks portion of the user sitting in the seat, said inner cushioning assembly including:

a support layer for supporting the buttocks portion of the user;

a comfort layer for contouring to the buttocks portion of the user providing comfort to the user being positioned on said support layer; and a covering for covering all of said layers;

wherein said inner cushioning assembly has a top and a bottom and a front end and a back end, said inner cushioning assembly having a length measured between said front and back ends, said inner cushioning assembly having a width measured in a direction extending substantially perpendicular to said length, said inner cushioning assembly having a thickness between said top and bottom;

wherein said width of said inner cushioning assembly tapers narrower from said back end toward said front end such that said inner cushioning assembly is wider at said back end than said front end;

wherein said thickness of said inner cushioning assembly tapers thinner from said back end toward said front end such that said inner cushioning assembly is thicker at said back end than said front end;

wherein said inner cushioning assembly has a channel extending from said rear end toward said front end for selectively receiving and supporting a tailbone portion of user, said channel extending between the top and the bottom of said inner cushioning assembly.

2. The transportable cushioning device of claim 1 wherein a thickness of said support layer tapers from said back end toward said front end of said support layer.

3. The transportable cushioning device of claim 1, wherein a width of said support layer tapers from said back end toward said front end.

4. The transportable cushioning device of claim 1, wherein said support layer comprises a resiliently compressible material.

5. The transportable cushioning device of claim 1, wherein a thickness of said comfort layer tapers from a back end of said support layer toward a central portion of said support layer.

6. The transportable cushioning device of claim 1, wherein said comfort layer comprises a plurality of foam beads.

7. The transportable cushioning device of claim 1, additionally including an intermediate layer being mounted on said support layer for separating said comfort layer from said support layer, and a channel extending through said intermediate layer.

8. The transportable cushioning device of claim 1, wherein a back portion of said covering is positioned in a channel extending through said support and comfort layers.

9. The transportable cushioning device of claim 8, wherein said back portion of said covering has a plurality of holes extending therethrough for allowing air in each of said layers to escape.

10. The transportable cushioning device of claim 1, additionally including a securing member for securing said inner cushion assembly to the seat, said securing member being mounted on said covering member and releaseably couplable to the seat.

11. The transportable cushioning device of claim 10, wherein a first end of said securing member is mounted on said covering, a second end of said securing member extending about the back support portion of the seat and releasably mounted on covering an elongated strap.

12. The transportable cushioning device of claim 11, wherein said securing member comprises an elongated strap.

13. The transportable cushioning device of claim 11, additionally including a fastening member for releasably fastening said second end of said securing member to said covering, said fastening member being mounted on said covering and releaseably couplable to said second end of said securing member.

14. The transportable cushioning device of claim 13, wherein said fastening member includes a first portion and a second portion, said first portion being mounted on said covering, said second portion being mounted said securing member and positioned generally adjacent to said second end of said securing member.

15. The transportable cushioning device of claim 13, wherein said fastening member comprises a hook and loop fastener.

16. A transportable cushioning device for supporting a buttocks portion of a user while sitting in a seat, the seat including a seat support portion, said device comprising:

an inner cushioning assembly for supporting the buttocks portion of the user sitting in the seat, said inner cushioning assembly including:

a support layer for supporting the buttocks portion of the user;

a comfort layer for contouring to the buttocks portion of the user providing comfort to the user being positioned on said support layer; and a covering for covering all of said layers;

wherein said inner cushioning assembly has a top and a bottom and a front end and a back end, said inner cushioning assembly having a length measured between said front and back ends, said inner cushioning assembly having a width measured in a direction extending substantially perpendicular to said length, said inner cushioning assembly having a thickness between said top and bottom;

wherein said width of said inner cushioning assembly tapers narrower from said back end toward said front end such that said inner cushioning assembly is wider at said back end than said front end;

wherein said thickness of said inner cushioning assembly tapers thinner from said back end toward said front end such that said inner cushioning assembly is thicker at said back end than said front end;

wherein said inner cushioning assembly has a channel extending from said rear end toward said front end for selectively receiving and supporting a tailbone portion of user, said channel extending between the top and the bottom of said inner cushioning assembly;

wherein a thickness of said support layer tapers from said back end toward said front end of said support layer;

wherein a width of said support layer tapers from said back end toward said front end;

wherein said support layer comprises a resiliently compressible material;

wherein a thickness of said comfort layer tapers from a back end of said support layer toward a central portion of said support layer;

an intermediate layer being mounted on said support layer for separating said comfort layer from said support layer, and a channel extending through said intermediate layer;

wherein a back portion of said covering is positioned in a channel extending through said support and comfort layers;

wherein said back portion of said covering has a plurality of holes extending therethrough for allowing air in each of said layers to escape;

a securing member for securing said inner cushion assembly to the seat, said securing member being mounted on said covering member and releaseably couplable to the seat;

wherein a first end of said securing member is mounted on said covering, a second end of said securing member extending about the back support portion of the seat and releasably mounted on covering an elongated strap;

wherein said securing member comprises an elongated strap;

a fastening member for releasably fastening said second end of said securing member to said covering, said fastening member being mounted on said covering and releaseably couplable to said second end of said securing member;

wherein said fastening member includes a first portion and a second portion, said first portion being mounted on said covering, said second portion being mounted said securing member and positioned generally adjacent to said second end of said securing member;

wherein said fastening member comprises a hook and loop fastener.

* * * * *